United States Patent [19]

Frehner

[11] 4,438,882

[45] Mar. 27, 1984

[54] NOZZLE, PARTICULARLY FOR BURNERS

[75] Inventor: Herbert Frehner, Boppelsen, Switzerland

[73] Assignee: Satronic AG, Regensdorf, Switzerland

[21] Appl. No.: 359,651

[22] PCT Filed: Jul. 7, 1981

[86] PCT No.: PCT/CH81/00075

§ 371 Date: Mar. 8, 1982

§ 102(e) Date: Mar. 8, 1982

[87] PCT Pub. No.: WO82/00333

PCT Pub. Date: Feb. 4, 1982

[30] Foreign Application Priority Data

Jul. 10, 1980 [CH] Switzerland ..... 5305/80

[51] Int. Cl.[3] ..... B05B 1/14

[52] U.S. Cl. ..... 239/462; 239/493; 239/590.3

[58] Field of Search ..... 239/462, 493, 553.3, 239/575, 590.3

[56] References Cited

U.S. PATENT DOCUMENTS 2,602,006 7/1952 Fahrbach ..... 239/462

4,320,875 3/1982 Sutter ..... 239/462

FOREIGN PATENT DOCUMENTS 197808 8/1978 Fed. Rep. of Germany ..... 239/462

*Primary Examiner*—John J. Love

*Assistant Examiner*—Mary F. McCarthy

[57] ABSTRACT

A nozzle having a nozzle casing with a whirl member positioned therein and which is pressed against the internally conical bottom of the nozzle casing. The fluid fed to nozzle bore is filtered in a filter and then passes into an annular channel. The latter contains a protective member with passage orifices which are at least as large as the passage orifices of the filter. The protective member holds back any particles detached in the filter or nozzle casing and consequently prevents clogging of whirl channels located in whirl member and of the nozzle bore. It is positioned in immediate proximity of the nozzle bore so as to trap the maximum number of particles.

1 Claim, 1 Drawing Figure

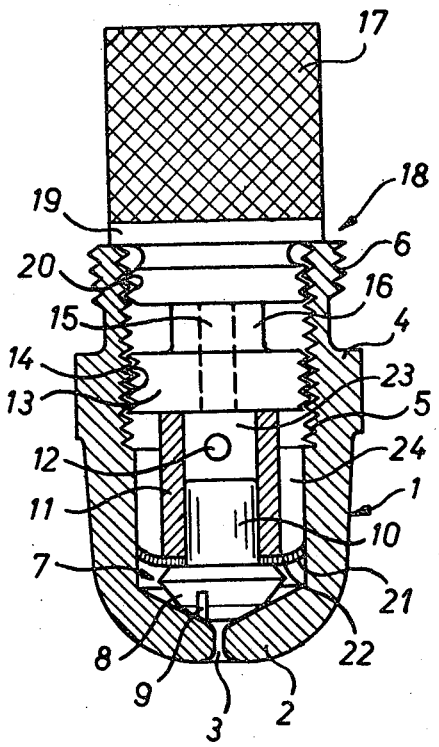
17
18
19
6
20
16
15
4
14
23
13
5
12
24
11
1
10
7
21
8
22
9
3
2

NOZZLE, PARTICULARLY FOR BURNERS

The invention relates to a nozzle, particulary for burners, which atomizes a fluid entering said nozzle and which on the inlet side is provided with a filter in the nozzle casing and on the outlet side has a nozzle bore in the bottom of the nozzle casing, a whirl member being incorporated into the nozzle casing cavity.

Nozzles as defined hereinbefore are widely used in burners for furnaces of all types. The nozzle as well as the nozzle casing are screwed into the nozzle assembly of the burner. A fluid, e.g. fuel oil is supplied under pressure to the nozzle and, generally accompanied by the formation of an angular momentum, is finely atomized by the nozzle bore and sprayed into the combustion chamber where it mixes with the combustion air fed in in the immediate vicinity thereof and ignites.

As the fluid supplied almost always contains impurities, it is known to pass the fluid through a filter before it enters the nozzle. This filter, which in the case of small nozzles is generally a sinter filter, is positioned at the inlet side of the nozzle, so that only filtered fluid enters the nozzle and the nozzle bore. The free passasge of the nozzle filter can be made so large that clogging of the nozzle is reliably prevented. This requires a passage width of about 70 to 100$\mu$.

In the case of burners for the heating systems of apartment blocks it has hitherto been standard practice to design them for a much higher capacity than was necessary for the maximum generation of heat e.g. in winter. This made it possible to provide the nozzles with sufficiently large passage cross-sections, so that there was little risk of clogging. However, as a result of this over-dimensioning of the burners, except in extremely cold weather, it was necessary to frequently switch off the burner to prevent excessive heat production. However, the frequent switching on and off of the burner is disadvantageous, because the state at the time of switching on and off does not correspond to the stationary or steady state, which leads to additional losses and also burdens the environment with unburned constituents.

With a view to saving oil and providing maximum environmental protection it is consequently advisable to move away from the conventional burner design and use much smaller burners resulting in far fewer switching on and off states. However, as a result the burner nozzles must be dimensioned for smaller dosing quantitites, which reduces the free passage cross-section for the fuel oil and therefore increases the risk of clogging. If the size of the passage cross-sections can only be reduced to the extent that the suspended particles in the oil can still pass through in an unimpeded manner and the variation of the dosing quantity must be achieved through the design of the burner nozzle, it is impossible to over-look the fact that in spite of the filter there can be an increase in the number of nozzle blockages. This is due to foreign bodies which can form in the burner nozzles and not to impurities in the fluid, which are retained by the filter. Thus, it is possible that particles, e.g. sinter particles can be floated off the filter or metal particles resulting from the machining or filting operations can be detached during the operation of the burner nozzle.

The problem of the invention is to so develop a nozzle of the aforementioned type that it is possible to reliably prevent clogging of the nozzle by particles which can occur in the latter. According to the invention this problem is solved in that in the fluid flow path between the filter and the nozzle bore a protective member having passage orifices is provided, the free passage through said passage orifices being at least as large as the free passage of the passage orifices of the filter.

An embodiment of the invention is shown in the drawing and is described hereinafter. The drawing is a longitudinal section through a burner nozzle with the object of the invention.

The nozzle shown in the drawing is intended for fuel oil of the type used in burners. It has a nozzle casing 1 with a bottom 2 containing a nozzle bore 3 and having a cylindrical part 4. Nozzle casing 1 consequently forms a hollow body, which houses the other parts of the nozzle.

At its free end nozzle casing 1 has an internal thread 5 and an external thread 6, the latter being used for screwing the nozzle into the not shown burner nozzle assembly.

Within nozzle casing 1 is mounted a whirl member 7 having a whirl member head 8 with whirl channels 9 and a whirl member shaft 10. Head 8 is conical and rests on the inside of a cone-forming bottom 2. The conical surface of whirl member head 8 and the cone of bottom 2 form a complete seal, so that the fluid flowing through the nozzle can only flow in through the whirl channels 9 of nozzle bore 3.

An assembly sleeve 11 with radial bores 12 is placed on whirl member shaft 10. Whirl member 7 is pressed via assembly sleeve 11 onto the cone of bottom 2 by an assembly screw 13 screwed with an external thread 14 into the internal thread 5 of nozzle casing 1. An axial bore 15 is provided in assembly screw 13. A pin 16 positioned on assembly screw 13 permits the screwing in of the latter, e.g. by constructing pin 16 with cross-slots or some other displacement possibility.

The internal thread 5 of nozzle casing 1 is also used for screwing on a filter 17. Filter 17 is mounted in a filter base 18 with a flange 19 and an external thread 20, which is screwed into the internal thread 5 of nozzle casing 1.

A protective member 21 is positioned between the shoulder formed by whirl member head 8 and assembly sleeve 11. Member 21 is in the form of a circular disk of sieve or screen material and is pressed against the shoulder of whirl member head 8 by sleeve 11. The function of protective member 21 is not to additionally filter the inflowing fluid. Therefore the passage orifices should be at least as large as the passage orifices of filter 17 and can be even larger than the filter orifices. However, they are still able to retain any particles floated off the filter or which become detached during assembly, e.g. on screwing together the parts or in operation. It is important that protective member 21 is positioned as close as possible to the nozzle bore, so that particles cannot appear between protective member 21 and nozzle bore 3. As is apparent from the drawing this is achieved through constructing protective member 21 and a sieve material ring. The fluid cleaned in the filter 17 admittedly passes through the ring, but is subject to no further filtering action due to same size of passage orifices 22. The function of protective member 21 is not to again filter the already filtered fluid, but to retain particles formed in filter 17 or nozzle casing 1.

Surprisingly protective member 21 makes it possible to operate in a substantially trouble free manner nozzles with a small passage cross-section. The fluid flowing through filter 17 passes via the axial bore 15 of assembly screw 13 into an area 23 surrounded by assembly sleeve 11 and from there via radial bores 12 into an annular channel 24 in which protective member 21 is positioned in the immediate vicinity of nozzle bore 3. Protective member 21 holds back any particles appearing in the filter and the fluid flow path, thereby substantially ensuring that there is no clogging of whirl channels 9 or nozzle bore 3.

I claim:

1. A nozzle for atomizing a fluid especially for use in burners, comprising: a hollow nozzle casing having an inflow side and an exit bore, a filter located at said inflow side and having orifices with a free passage, a whirl member in said casing and having a whirl member head at said exit bore, an annular channel between the inner wall of said casing and said whirl member, and an annular protective member formed by a sheet of sieve material in said annular channel at said whirl member head and having orifices with a free passage larger than the free passage of said filter orifices, said sheet being positioned between said whirl member head and an assembly sleeve, said annular channel being defined by the inner wall of said nozzle casing and the outer wall of the assembly sleeve, whereby impurities contained in the fluid are retained in the filter, and impurities originating from the nozzle are retained by said protective member.

* * * * *